US009431690B2

(12) United States Patent
Rogozine et al.

(10) Patent No.: US 9,431,690 B2
(45) **Date of Patent: *Aug. 30, 2016**

(54) DIELECTRIC WAVEGUIDE FILTER WITH DIRECT COUPLING AND ALTERNATIVE CROSS-COUPLING

(71) Applicant: CTS Corporation, Elkhart, IN (US)

(72) Inventors: Alexandre Rogozine, Rio Rancho, NM (US); Reddy Vangala, Albuquerque, NM (US)

(73) Assignee: CTS Corporation, Elkhart, IN (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/842,920

(22) Filed: Sep. 2, 2015

(65) Prior Publication Data

US 2015/0380792 A1 Dec. 31, 2015

Related U.S. Application Data

(63) Continuation of application No. 14/088,471, filed on Nov. 25, 2013, now Pat. No. 9,130,255.

(51) Int. Cl.

| | |
|---|---|
| ***H01P 1/20*** | (2006.01) |
| ***H01P 7/10*** | (2006.01) |
| ***H01P 1/208*** | (2006.01) |

(52) U.S. Cl.

CPC ..... *H01P 1/2002* (2013.01); *H01P 1/2088* (2013.01); *H01P 7/10* (2013.01)

(58) Field of Classification Search

CPC ..... H01P 1/2088; H01P 7/10; H01P 1/2002
USPC ..... 333/202–212, 219.1
See application file for complete search history.

(56) References Cited

U.S. PATENT DOCUMENTS

| | | | |
|---|---|---|---|
| 3,882,434 | A | 5/1975 | Levy |
| 3,955,161 | A | 5/1976 | MacTurk |

(Continued)

FOREIGN PATENT DOCUMENTS

| | | | |
|---|---|---|---|
| CN | 201898182 | U | 7/2011 |
| CN | 102361113 | A | 2/2012 |

(Continued)

OTHER PUBLICATIONS

Ruiz-Cruz J et al: "Rectangular Waveguide Elliptic Filters with Capacitive and Inductive Irises and Integrated Coaxial Excitation", 2005 IEEE MTT-S International Microwave Symposium, Piscataway, NJ, USA, IEEE, (Jun. 12, 2005) pp. 269-272, EP010844740, DOI: 10.1109/MWSYM.2005.1516577, ISBN: 978-0-7803-8846-8 p. 269; figures 1,3.

(Continued)

*Primary Examiner* — Robert Pascal
*Assistant Examiner* — Rakesh Patel
(74) *Attorney, Agent, or Firm* — Daniel J. Deneufbourg

(57) ABSTRACT

A dielectric waveguide filter comprising a block of dielectric material covered with an exterior layer of conductive material. A plurality of stacked resonators are defined in the block of dielectric material by one or more slots in the block of dielectric material and an interior layer of conductive material that separates the stacked resonators. First and second RF signal transmission windows in the interior layer of conductive material provide for both direct and cross-coupling RF signal transmission between the stacked resonators. In one embodiment, the waveguide filter is comprised of separate blocks of dielectric material each covered with an exterior layer of conductive material, each including one or more slots defining a plurality of resonators, and coupled together in a stacked relationship.

8 Claims, 5 Drawing Sheets

(56) References Cited

U.S. PATENT DOCUMENTS

| | | | |
|---|---|---|---|
| 4,396,896 | A | 8/1983 | Williams |
| 4,431,977 | A | 2/1984 | Sokola et al. |
| 4,609,892 | A | 9/1986 | Higgins, Jr. |
| 4,692,726 | A | 9/1987 | Green et al. |
| 4,706,051 | A | 11/1987 | Dieleman et al. |
| 4,733,208 | A | 3/1988 | Ishikawa et al. |
| 4,742,562 | A | 5/1988 | Kommrusch |
| 4,800,348 | A | 1/1989 | Rosar et al. |
| 4,806,889 | A | 2/1989 | Nakano et al. |
| 4,837,535 | A | 6/1989 | Konishi et al. |
| 4,940,955 | A | 7/1990 | Higgins, Jr. |
| 4,963,844 | A | 10/1990 | Konishi et al. |
| 4,996,506 | A | 2/1991 | Ishikawa et al. |
| 5,004,992 | A | 4/1991 | Grieco et al. |
| 5,023,944 | A | 6/1991 | Bradley |
| 5,130,682 | A | 7/1992 | Agahi-Kesheh |
| 5,208,565 | A | 5/1993 | Sogo et al. |
| 5,243,309 | A | 9/1993 | L'Ecuyer |
| 5,285,570 | A | 2/1994 | Fulinara |
| 5,288,351 | A | 2/1994 | Hoang et al. |
| 5,365,203 | A | 11/1994 | Nakamura et al. |
| 5,382,931 | A | 1/1995 | Piloto et al. |
| 5,416,454 | A | 5/1995 | McVeety |
| 5,525,946 | A | 6/1996 | Tsujiguchi et al. |
| 5,528,204 | A | 6/1996 | Hoang et al. |
| 5,528,207 | A | 6/1996 | Ito |
| 5,537,082 | A | 7/1996 | Tada et al. |
| 5,572,175 | A | 11/1996 | Tada et al. |
| 5,602,518 | A | 2/1997 | Clifford, Jr. et al. |
| 5,719,539 | A | 2/1998 | Ishizaki et al. |
| 5,731,751 | A | 3/1998 | Vangala |
| 5,821,836 | A | 10/1998 | Katehi et al. |
| 5,850,168 | A | 12/1998 | McVeety et al. |
| 5,926,078 | A | 7/1999 | Hino et al. |
| 5,926,079 | A | 7/1999 | Heine et al. |
| 5,929,726 | A | 7/1999 | Ito et al. |
| 5,999,070 | A | 12/1999 | Endo |
| 6,002,306 | A | 12/1999 | Arakawa et al. |
| 6,023,207 | A | 2/2000 | Ito et al. |
| 6,026,281 | A | 2/2000 | Yorita |
| 6,137,383 | A | 10/2000 | De Lillo |
| 6,154,106 | A | 11/2000 | De Lillo |
| 6,160,463 | A | 12/2000 | Arakawa et al. |
| 6,181,225 | B1 | 1/2001 | Bettner |
| 6,255,921 | B1 | 7/2001 | Arakawa et al. |
| 6,281,764 | B1 | 8/2001 | Arakawa et al. |
| 6,329,890 | B1 | 12/2001 | Brooks et al. |
| 6,351,198 | B1 | 2/2002 | Tsukamoto et al. |
| 6,437,655 | B1 | 8/2002 | Andoh et al. |
| 6,504,446 | B1 | 1/2003 | Ishihara et al. |
| 6,535,083 | B1 | 3/2003 | Hageman et al. |
| 6,549,095 | B2 | 4/2003 | Ishihara et al. |
| 6,559,740 | B1 | 5/2003 | Schulz et al. |
| 6,568,067 | B2 | 5/2003 | Takeda |
| 6,594,425 | B2 | 7/2003 | Tapalian et al. |
| 6,677,837 | B2 | 1/2004 | Kojima et al. |
| 6,757,963 | B2 | 7/2004 | Meier et al. |
| 6,791,403 | B1 | 9/2004 | Tayrani et al. |
| 6,801,106 | B2 | 10/2004 | Ono et al. |
| 6,834,429 | B2 | 12/2004 | Blair et al. |
| 6,844,861 | B2 | 1/2005 | Peterson |
| 6,888,973 | B2 | 5/2005 | Kolodziejski et al. |
| 6,900,150 | B2 | 5/2005 | Jacquin et al. |
| 6,909,339 | B2 | 6/2005 | Yonekura et al. |
| 6,909,345 | B1 | 6/2005 | Salmela et al. |
| 6,927,653 | B2 | 8/2005 | Uchimura et al. |
| 6,977,560 | B2 | 12/2005 | Iroh et al. |
| 6,977,566 | B2 | 12/2005 | Fukunaga |
| 7,009,470 | B2 | 3/2006 | Yatabe et al. |
| 7,068,127 | B2 | 6/2006 | Wilber et al. |
| 7,132,905 | B2 | 11/2006 | Sano |
| 7,142,074 | B2 | 11/2006 | Kim et al. |
| 7,170,373 | B2 | 1/2007 | Ito et al. |
| 7,271,686 | B2 | 9/2007 | Yoshikawa et al. |
| 7,323,954 | B2 | 1/2008 | Lee et al. |
| 7,449,979 | B2 | 11/2008 | Koh et al. |
| 7,545,235 | B2 | 6/2009 | Mansour et al. |
| 7,659,799 | B2 | 2/2010 | Jun et al. |
| 7,714,680 | B2 | 5/2010 | Vangala et al. |
| 8,008,993 | B2 | 8/2011 | Milson et al. |
| 8,072,294 | B2 | 12/2011 | Tanpo et al. |
| 8,171,617 | B2 | 5/2012 | Vangala |
| 8,284,000 | B2 | 10/2012 | Fukunaga |
| 8,314,667 | B2 | 11/2012 | Uhm et al. |
| 8,823,470 | B2 | 9/2014 | Vangala |
| 9,130,255 | B2 | 9/2015 | Rogozine et al. |
| 9,130,256 | B2 | 9/2015 | Rogozine et al. |
| 9,130,257 | B2 | 9/2015 | Vangala |
| 9,130,258 | B2 | 9/2015 | Vangala et al. |
| 2001/0024147 | A1 | 9/2001 | Arakawa et al. |
| 2002/0024410 | A1 | 2/2002 | Guglielmi et al. |
| 2003/0006865 | A1 | 1/2003 | Kim et al. |
| 2004/0000968 | A1 | 1/2004 | White et al. |
| 2004/0056737 | A1 | 3/2004 | Carpintero et al. |
| 2004/0129958 | A1 | 7/2004 | Kho et al. |
| 2004/0257194 | A1 | 12/2004 | Casey et al. |
| 2005/0057402 | A1 | 3/2005 | Ohno et al. |
| 2007/0120628 | A1 | 5/2007 | Jun et al. |
| 2009/0015352 | A1 | 1/2009 | Goebel et al. |
| 2009/0102582 | A1 | 4/2009 | Van Der Heijden et al. |
| 2009/0146761 | A1 | 6/2009 | Nummerdor |
| 2009/0201106 | A1 | 8/2009 | Iio et al. |
| 2009/0231064 | A1 | 9/2009 | Bates et al. |
| 2010/0024973 | A1 | 2/2010 | Vangala |
| 2010/0253450 | A1 | 10/2010 | Kim et al. |
| 2011/0279200 | A1 | 11/2011 | Vangala |
| 2012/0229233 | A1 | 9/2012 | Ito |
| 2012/0286901 | A1 | 11/2012 | Vangala |
| 2013/0214878 | A1 | 8/2013 | Gorisse et al. |

FOREIGN PATENT DOCUMENTS

| | | | |
|---|---|---|---|
| DE | 102008017967 | A1 | 10/2009 |
| EP | 0322993 | A2 | 7/1989 |
| EP | 0322993 | A3 | 4/1990 |
| EP | 0444948 | A2 | 3/1991 |
| EP | 0757401 | A2 | 2/1997 |
| EP | 0859423 | A1 | 8/1998 |
| EP | 1024548 | A1 | 2/2000 |
| EP | 0997964 | A2 | 5/2000 |
| EP | 0997964 | A3 | 9/2001 |
| EP | 1439599 | A1 | 7/2004 |
| FR | 2318512 | A1 | 2/1977 |
| JP | 62038601 | | 2/1987 |
| JP | 2003298313 | | 10/2003 |
| JP | 2006157486 | | 6/2006 |
| WO | 9509451 | | 4/1995 |
| WO | 0024080 | | 4/2000 |
| WO | 0038270 | A1 | 6/2000 |
| WO | 2005091427 | | 9/2005 |

OTHER PUBLICATIONS

Paul Wade: "Rectangular Waveguide to Coax Transition Design", QEX, Nov./Dec. 2006, pp. 10-17, published by American Radio Relay League, Newington, Connecticut, US.

Yoji Isota, Moriyasu Miyazaki, Osami Ishida, Fumio Takeda, Mitsubishi Electric Corporation. "A Grooved Monoblock Comb-Line Filter Suppressing the Third Harmonics", IEEE 1987 MTT-S Digest, pp. 383-386, published by IEEE, New York, New York, US.

C. Choi, Fig. 2.13, Monolithic Plated Ceramic Waveguide Filters, Mar. 31, 1986, Motorola, Inc., Schaumburg, Illinois, U.S.

Kocbach J. et al: "Design Procedure for Waveguide Filters with Cross-Couplings", 2002 IEEE MTT-S International Microwave Symposium Digest (Cat. No. 02CH37278) IEEE Piscataway, NJ, USA; IEEE MTT-S International Microwave Symposium, IEEE, Jun. 2, 2002, pp. 1449-1452, XP001113877, DOI: 10.1109/WMSYM.2002.1012128 ISBN: 978-0-8703-7239-9 abstract; figure 1.

N. Marcuvitz, Waveguide Handbook, McGraw-Hill Book Co., New York City, Ch. 5, 1951.

(56) References Cited

OTHER PUBLICATIONS

Y. Konishi, "Novel dielectric waveguide components-microwave applications of new ceramic materials," Proc. IEEE, vol. 79, pp. 726-740, Jun. 1991.
K. Sano, "Dielectric waveguide filter with low profile and low insertion loss," IEEE Trans. on Microwave Theory & Tech., vol. 47, pp. 2299-2303, Dec. 1999.
K. Sano and T. Yoneyama, "A transition from Microstrip to Dielectric Filled Rectangular Waveguide in Surface Mounting," IEEE MTT-S Int. Microwave Symp. Digest, pp. 813-816, 2002.
I. Awai, A.C. Kundu, and T. Yamashita, "Equivalent circuit representation and explanation of attenuation poles of a dual-mode dielectric resonator bandpass filter," IEEE Trans. Microwave Theory & Tech., vol. 46, pp. 2159-2163, Dec. 1998.
A.D. Lapidus and C. Rossiter, "Cross-coupling in microwave bandpass filters," Microwave Journal, pp. 22-46, Nov. 2004.
Tze-min Shen; Chi-Feng Chen' Huang, Ting-Yi; Wu, Ruey-Beei, "Design of Vertically Stacked Waveguide Filters in LTCC," Microwave Theory and Techniques, IEEE Transactions on, vol. 55, No. 8, pp. 1771,1779, Aug. 2007.
Hung-Yi Chien; Tze-Min Shen; Huang; Ting-Yi; Wei-Hsin Wang; Wu, Ruey-Beei, "Miniaturized Bandpass Filters with Double-Folded Substrate Integrated Resonators in LTCC," Microwave Theory and Techniques, IEEE Transactions on vol. 57, No. 7, pp. 1774, 1782, Jul. 2009.
Bo-Jiun Chen; Tze-Min Shen; Wu, Ruey-Beei, "Dual Band Vertically Stacked Laminated Waveguide Filter Design in LTCC Technology," Microwave Theory and Techniques, IEEE Transactions on, vol. 57, No. 6, pp. 1554, 1562, Jun. 2009.
Wolfram Wersing, Microwave ceramics for resonators and filters, Current Opinion in Solid State and Materials Science, vol. 1, Issue 5, Oct. 1996, pp. 715-731, ISSN 1359-0286.
Shen T et al, Full-Wave Design of Canonical Waveguide Filters by Optimation, 2001 IEEE MTT-S International Microwave Symposium Digest. (IMS 2001) Phoenix, AZ, May 20-25, 2001, pp. 1487-1490.
John David Rhodes, The Generalized Direct-Coupled Cavity Linear Phase Filter, IEEE Transactions on Microwave Theory and Techniques, vol. MTT-18, No. 6, Jun. 1, 1970, pp. 308-313, XP001401320, abstract.
Y. Cassivi et al, Low-Cost and High-Q Millimeter-Wave Resonator Using Substrate Integrated Waveguide Technique, Microwave Conference, 2002. 32nd European, pp. 1-4.

DIELECTRIC WAVEGUIDE FILTER WITH DIRECT COUPLING AND ALTERNATIVE CROSS-COUPLING

CROSS-REFERENCE TO RELATED AND CO-PENDING APPLICATIONS

This application is a continuation patent application which claims the benefit of the filing date of U.S. patent application Ser. No. 14/088,471 filed on Nov. 25, 2013 now U.S. Pat. No. 9,130,255 issued on Sep. 8, 2015, entitled "Dielectric Waveguide Filter with Direct Coupling and Alternative Cross-Coupling", the disclosure of which is incorporated herein by reference as are all references cited therein, which claimed the benefit of the filing date and disclosure of U.S. Provisional Application Ser. No. 61/730,615 filed on Nov. 28, 2012, the contents of which are entirely incorporated herein by reference as are all of references cited therein, and further claimed the benefit of the filing date and disclosure of, and is a continuation-in-part of, U.S. application Ser. No. 13/103,712 filed on May 9, 2011 now U.S. Pat. No. 8,823,470 issued on Sep. 2, 2014 and titled "Dielectric Waveguide Filter with Structure and Method for Adjusting Bandwidth", U.S. application Ser. No. 13/373,862 filed on Dec. 3, 2011 now U.S. Pat. No. 9,030,279 issued on May 12, 2015 and titled "Dielectric Waveguide Filter with Direct Coupling and Alternative Cross-Coupling", and U.S. application Ser. No. 13/564,822 filed on Aug. 2, 2012 now U.S. Pat. No. 9,030,278 issued on May 12, 2015 and titled "Tuned Dielectric Waveguide Filter and Method of Tuning", the contents of which are also entirely incorporated herein by reference as are all of the references cited therein.

FIELD OF THE INVENTION

The invention relates generally to dielectric waveguide filters and, more specifically, to a dielectric waveguide filter with direct coupling and alternative cross-coupling.

BACKGROUND OF THE INVENTION

This invention is related to a dielectric waveguide filter of the type disclosed in U.S. Pat. No. 5,926,079 to Heine et al. In which a plurality of resonators are spaced longitudinally along the length of a monoblock and in which a plurality of slots/notches are spaced longitudinally along the length of the monoblock and define a plurality of bridges between the plurality of resonators which provide a direct inductive/capacitive coupling between the plurality of resonators.

The attenuation characteristics of a waveguide filter of the type disclosed in U.S. Pat. No. 5,926,079 to Heine et al. can be increased through the incorporation of zeros in the form of additional resonators located at one or both ends of the waveguide filter. A disadvantage associated with the incorporation of additional resonators, however, is that it also increases the length of the filter which, in some applications, may not be desirable or possible due to, for example, space limitations on a customer's motherboard.

The attenuation characteristics of a filter can also be increased by both direct and cross-coupling the resonators as disclosed in, for example, U.S. Pat. No. 7,714,680 to Vangala et al. which discloses a monoblock filter with both inductive direct coupling and quadruplet cross-coupling of resonators created in part by respective metallization patterns which are defined on the top surface of the filter and extend between selected ones of the resonator through-holes to provide the disclosed direct and cross-coupling of the resonators.

Direct and cross-coupling of the type disclosed in U.S. Pat. No. 7,714,680 to Vangala et al. and comprised of top surface of metallization patterns is not applicable in waveguide filters of the type disclosed in U.S. Pat. No. 5,926,079 to Heine et al. which includes only slots and no top surface metallization patterns.

The present invention is thus directed to a dielectric waveguide filter with both direct and optional cross-coupled resonators which allow for an increase in the attenuation characteristics of the waveguide filter without an increase in the length of the waveguide filter or the use of metallization patterns on the top surface of the filter.

SUMMARY OF THE INVENTION

The present invention is directed to a dielectric waveguide filter comprising a block of dielectric material including a plurality of exterior surfaces covered with an exterior layer of conductive material, a plurality of stacked resonators defined in the block of dielectric material by one or more slots extending into the block of dielectric material and an interior layer of conductive material that separates the plurality of stacked resonators, at least a first RF signal input/output electrode defined on the block of dielectric material, and a first RF signal transmission window defined in the interior layer of conductive material and defining a direct path for the transmission of an RF signal between the plurality of stacked resonators.

In one embodiment, first and second slots extend into one or more of the exterior surfaces of the block of dielectric material and separate the block of dielectric material into at least first and second stacked resonators and third and fourth stacked resonators, the first RF signal transmission window being defined in the interior layer of conductive material between the first and second stacked resonators and a second RF signal transmission window is defined in the interior layer of conductive material and defines an indirect path for the transmission of the RF signal between the third and fourth stacked resonators.

In one embodiment, a second RF signal input/output electrode is defined in the block of dielectric material in a relationship relative to the first RF signal input/output electrode to define a generally oval shaped direct path for the transmission of the RF signal through the dielectric waveguide filter.

In one embodiment, the block of dielectric material defines a longitudinal axis and the first and second RF signal input/output electrodes are defined by respective first and second through-holes extending through the block of dielectric material, the first and second slots and the first and second through-holes extending in a direction transverse to the direction of the longitudinal axis, and the first and second through-holes being disposed in a diametrically opposed and co-linear relationship on opposite sides of the interior layer of conductive material.

In one embodiment, the block of dielectric material is comprised of first and second separate blocks of dielectric material each including a plurality of exterior surfaces covered with an exterior layer of conductive material and defining the interior layer of conductive material when the first and second separate blocks of dielectric material are stacked on each other, the first slot being defined in the first block of dielectric material and separating the first block of dielectric material into the first and third resonators, the second slot being defined in the second block of dielectric material and separating the second block of dielectric material into the second and fourth resonators, the respective first and second RF signal transmission windows being defined by respective windows in the layer of conductive material which covers the exterior surface of each of the first and second blocks of dielectric material.

The present invention is also directed to a dielectric waveguide filter comprising a first block of dielectric material including a plurality of exterior surfaces covered with a layer of conductive material and at least a first slot extending into one or more of the exterior surfaces and separating the first block of dielectric material into at least first and second resonators, a first RF signal input/output electrode defined at one end of the first block of dielectric material, and a second block of dielectric material including a plurality of exterior surfaces covered with a layer of conductive material and at least a second slot extending into one or more of the exterior surfaces and separating the second block of dielectric material into at least third and fourth resonators, the second block of dielectric material being stacked on the first block of dielectric material in a relationship wherein the first and fourth resonators are stacked on each other and the second and third resonators are stacked on each other and a first direct generally oval shaped RF signal transmission path is defined through the waveguide filter.

In one embodiment, the first direct RF signal transmission path is defined in part by a first RF signal transmission window located between the second and third stacked resonators.

In one embodiment, the first direct RF signal transmission window is defined by respective first and second windows in the layer of conductive material covering the exterior surface of the respective first and second blocks of dielectric material.

In one embodiment, a second RF signal transmission window located is between the first and fourth stacked resonators for providing an indirect path for the transmission of the RF signal between the first and fourth resonators.

In one embodiment, the second RF signal transmission window is defined by respective third and fourth windows in the layer of conductive material covering the exterior surface of the respective first and second blocks of dielectric material.

In one embodiment, a second RF signal input/output electrode is defined at one end of the second block of dielectric material and positioned in a relationship diametrically opposed to the first RF signal input/output electrode defined at the one end of the first block of dielectric material, the first and second RF signal input/output electrodes being defined by respective first and second through-holes extending through the respective first and second blocks of dielectric material.

In one embodiment, respective first and second steps are defined in the respective one ends of the first and second blocks of dielectric material, the respective first and second through-holes extending through the respective first and second steps.

The present invention is further directed to a dielectric waveguide filter comprising a first block of dielectric material defining a first longitudinal axis and including a plurality of exterior surfaces covered with a layer of conductive material, a first plurality of slots defined in the first block of dielectric material and extending in a direction opposite the direction of the first longitudinal axis and separating the first block of dielectric material into a first plurality of resonators extending along the first longitudinal axis, and a first step defined at one end of the first block of dielectric material, a first RF signal input/output through-hole defined in the step of the first block of dielectric material, a second block of dielectric material seated against the first block of dielectric material, the second block of dielectric material defining a second longitudinal axis and including a plurality of exterior surfaces covered with a layer of conductive material, a second plurality of slots defined in the second block of dielectric material and extending in a direction opposite the direction of the second longitudinal axis and separating the second block of dielectric material into a second plurality of resonators extending along the second longitudinal axis, and a second step defined at one end of the second block of dielectric material, a second RF signal input/output through-hole defined in the step of the second block of dielectric material, and a first direct RF signal transmission path defined by the combination of the first and second RF signal input/output through-holes and the plurality of resonators in the first and second blocks of dielectric material.

In one embodiment, the first direct RF signal transmission path is defined in part by a first direct RF signal transmission means located between a first one of the first plurality of resonators in the first block of dielectric material and a first one of the second plurality of resonators in the second block of dielectric material.

In one embodiment, the first direct RF signal transmission means is defined by respective first and second windows defined in the layer of conductive material covering the exterior surface of the respective first and second blocks of dielectric material.

In one embodiment, a first indirect RF signal transmission means defines a first indirect coupling path for the transmission of the RF signal from a second one of the first plurality of resonators in the first block of dielectric material to a second one of the second plurality of resonators in the second block of dielectric material.

In one embodiment, the first indirect RF signal transmission line means is defined by respective third and fourth windows defined in the layer of conductive material covering the plurality of exterior surfaces of the respective first and second blocks of dielectric material.

In one embodiment, the first direct RF signal transmission path is generally oval in shape.

Other advantages and features of the present invention will be more readily apparent from the following detailed description of the preferred embodiment of the invention, the accompanying drawings, and the appended claims.

BRIEF DESCRIPTION OF THE DRAWINGS

These and other features of the invention can best be understood by the following description of the accompanying FIGURES as follows.

DETAILED DESCRIPTION OF THE EMBODIMENTS

Figure 1:
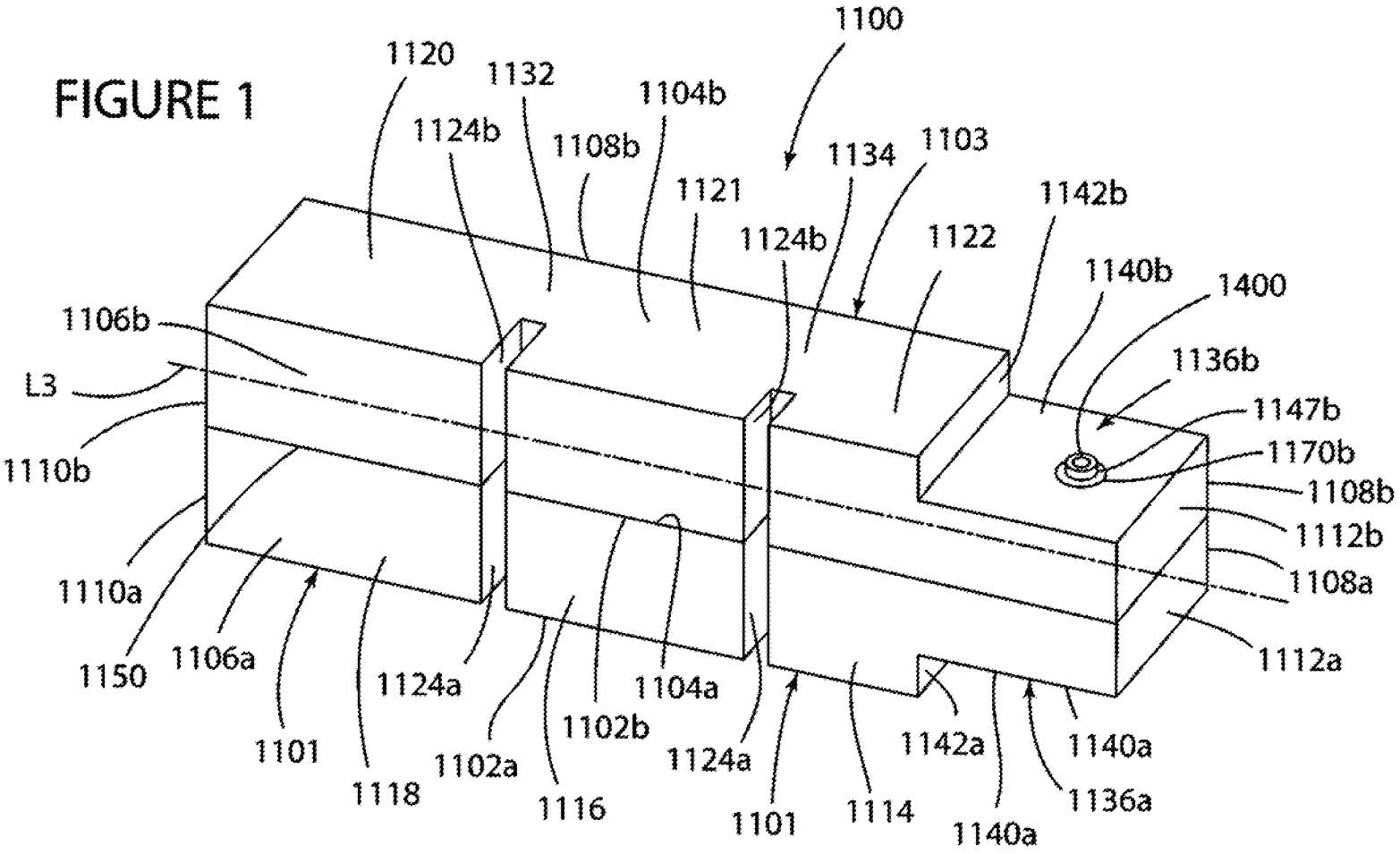
FIG. 1 is an enlarged perspective view of a dielectric waveguide filter according to the present invention.
Figure 2:
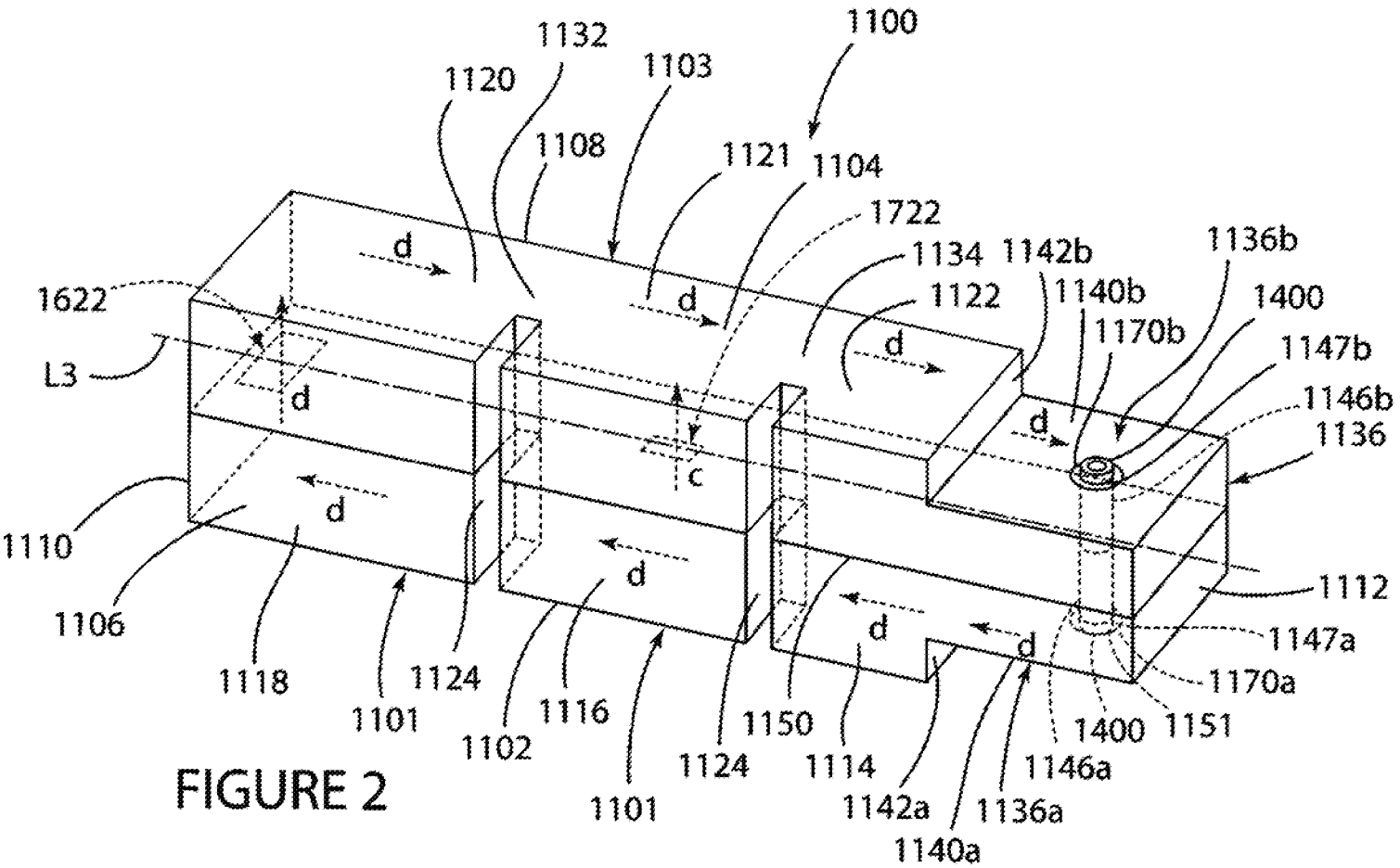
FIG. 2 is an enlarged, part phantom, perspective view of the dielectric waveguide filter shown in FIG. 1.
Figure 3:
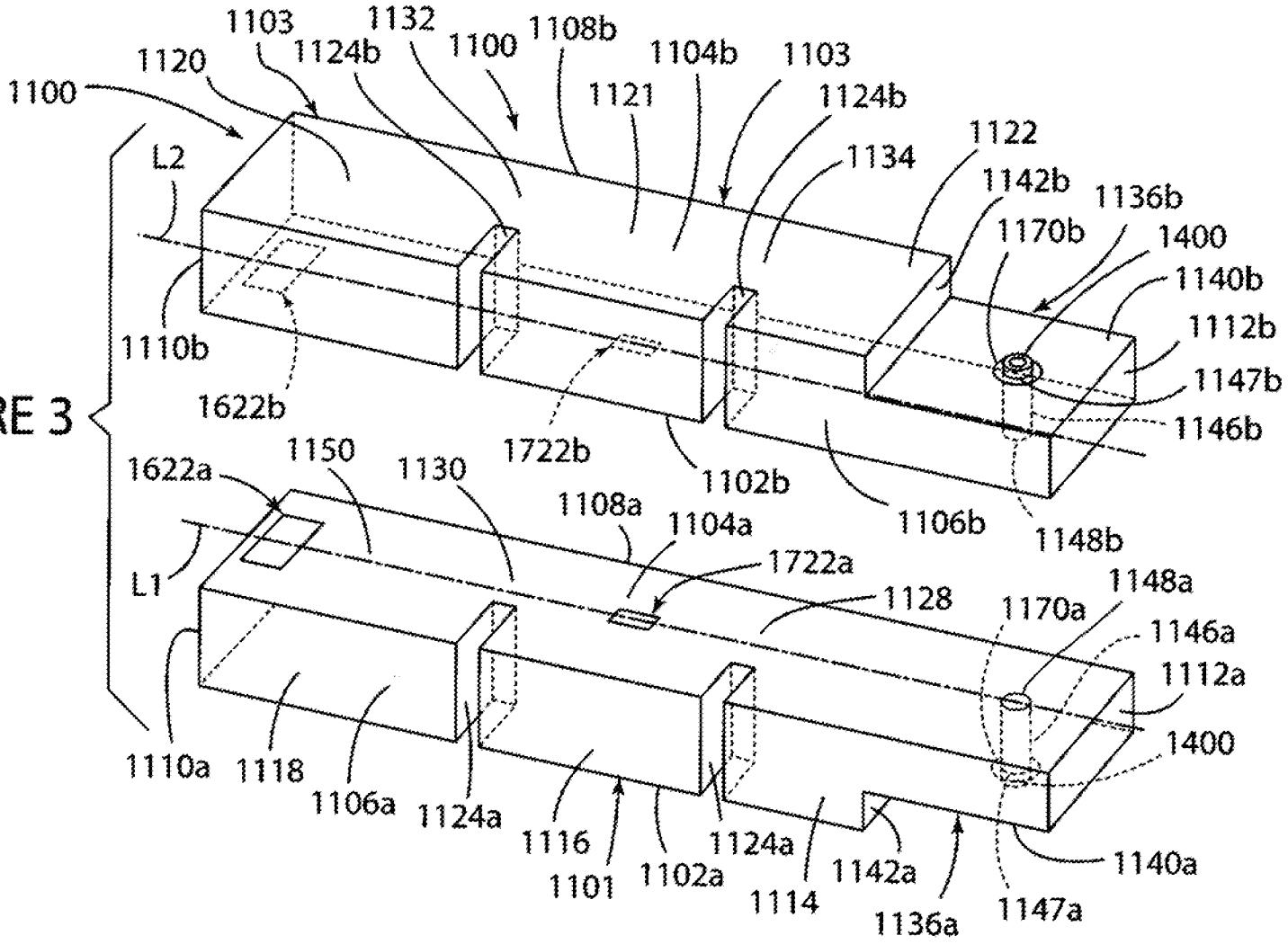
FIG. 3 is an enlarged, exploded, part phantom, perspective view of the two blocks of the dielectric waveguide filter shown in FIG. 1.

FIGS. 1, 2, and 3 depict a waveguide filter 1100 incorporating both direct and alternative cross-coupling/indirect coupling features and characteristics in accordance with the present invention.

In the embodiment shown, the waveguide filter 1100 is made from a pair of separate generally parallelepiped-shaped monoblocks of dielectric material 1101 and 1103 which have been coupled together in a stacked relationship to form the waveguide filter 1100.

The bottom monoblock 1101 is comprised of a suitable solid block or core of dielectric material, such as for example ceramic, and includes opposed longitudinal horizontal exterior surfaces 1102*a* and 1104*a*, opposed longitudinal side vertical exterior surfaces 1106*a* and 1108*a* that are disposed in a relationship normal to and extend between the horizontal exterior surfaces 1102*a* and 1104*a*, and opposed transverse end side vertical exterior end surfaces 1110*a* and 1112*a* that are disposed in a relationship generally normal to and extend between the longitudinal horizontal exterior surfaces 1102*a* and 1104*a* and the longitudinal vertical exterior surfaces 1102*a* and 1102*b*.

Thus, in the embodiment shown, each of the surfaces 1102*a*, 1104*a*, 1106*a*, and 1108*a* extends in the same direction as the longitudinal axis L1 (FIG. 3) of the monoblock 1101 and each of the end surfaces 1110*a* and 1112*a* extends in a direction transverse or normal to the direction of the longitudinal axis L1 of the monoblock 1101.

The top monoblock 1103 is also comprised of a suitable solid block or core of dielectric material, such as for example ceramic, and includes opposed longitudinal horizontal exterior surfaces 1102*b* and 1104*b*, opposed longitudinal side vertical exterior surfaces 1106*b* and 1108*b* disposed in a relationship normal to and extending between the horizontal exterior surfaces 1102*b* and 1104*b*, and opposed transverse end side vertical exterior surfaces 1110*b* and 1112*b* disposed in a relationship normal to and extending between the horizontal exterior surfaces 1102*b* and 1104*b* and the longitudinal side vertical exterior surfaces 1106*b* and 1108*b*.

Thus, in the embodiment shown, each of the surfaces 1102*b*, 1104*b*, 1106*b*, and 1108*b* extends in the same direction as the longitudinal axis L2 (FIG. 3) of the monoblock 1103 and each of the surfaces 1110*b* and 1112*b* extends in a direction transverse or normal to the direction of the longitudinal axis L2 of the monoblock 1103.

The monoblocks 1101 and 1103 include respective first and second pluralities of resonant sections (also referred to as cavities or cells or resonators) 1114, 1116, and 1118 and 1120, 1121, and 1122 which are spaced longitudinally along the length of, and extend co-linearly with and in the same direction as the longitudinal axis L1 and L2 of, the respective monoblocks 1101 and 1103 and are separated from each other by a plurality of (and more specifically a pair in the embodiment of FIGS. 1, 2, and 3) spaced-apart and generally parallel vertical slits or slots 1124*a* in the monoblock 1101 that are cut into the vertical exterior surface 1106*a* and, more specifically, are cut into the surfaces 1102*a*, 1104*a*, and 1106*a* of the monoblock 1101, and a pair of spaced-apart and generally parallel vertical slits or slots 1124*b* in the monoblock 1103 that are cut into the vertical exterior surface 1106*b* and, more specifically, are cut into the surfaces 1102*b*, 1104*b*, and 1106*b* of the monoblock 1103.

Thus, in the embodiment shown, each of the vertical slits or slots 1124*a* and 1124*b* extend in a direction generally transverse or normal to the direction of the longitudinal axis L1 and L2 of the respective monoblocks 1101 and 1103.

As shown in FIG. 3, the one of the slits 1124*a* in the bottom monoblock 1101 defines a first bridge or through-way or pass 1128 on the monoblock 1101 for the passage and transmission of an RF signal between the resonator 1114 and the resonator 1116 while the other of the slits 1124*a* in the monoblock 1101 defines a second bridge or through-way or pass 1130 on the monoblock 1101 for the passage and transmission of an RF signal between the resonator 1116 and the resonator 1118.

Similarly, and as also shown in FIG. 3, the one of the slits 1124*b* in the monoblock 1103 defines a first bridge or through-way or pass 1134 on the monoblock 1103 for the passage and transmission of an RF signal between the resonator 1122 and the resonator 1121 while the other of the slits 1124*b* in the monoblock 1103 defines a second bridge or through-way or pass on the monoblock 1103 for the passage and transmission of an RF signal between the resonator 1121 and the resonator 1120.

The monoblock 1101, and more specifically the end resonator 1114 of the monoblock 1101, additionally comprises and defines an end step 1136*a* comprising, in the embodiment shown, a generally L-shaped recessed or grooved or shouldered or notched region or section of the longitudinal surface 1102*a*, opposed side surfaces 1106*a* and 1108*a*, and side end surface 1112*a* of the monoblock 1101 from which dielectric ceramic material has been removed or is absent.

The monoblock 1103, and more specifically the end resonator 1122 of the monoblock 1103, similarly additionally comprises and defines an end step 1136*b* comprising, in the embodiment shown, a generally L-shaped recessed or grooved or shouldered or notched region or section of the longitudinal surface 1104*b*, opposed side surfaces 1106*b* and 1108*b*, and side end surface 1112*b* of the monoblock 1103 from which dielectric material has been removed or is absent.

Stated another way, in the embodiment shown, the respective steps 1136*a* and 1136*b* are defined in and by an end section or region of the respective monoblocks 1101 and 1103 having a height or thickness less than the height or thickness of the remainder of the respective monoblocks 1101 and 1103.

Further, in the embodiment shown, the respective end steps 1136*a* and 1136*b* each comprise a generally L-shaped recessed or notched portion of the respective end resonators 1114 and 1122 defined on the respective monoblocks 1101 and 1103 which include respective first generally horizontal surfaces 1140*a* and 1140*b* located or directed inwardly of, spaced from, and parallel to the surfaces 1102*a* and 1104*b* of the respective monoblocks 1101 and 1103 and respective second generally vertical surfaces or walls 1142*a* and 1142*b* located or directed inwardly of, spaced from, and parallel to, the respective side end surfaces 1110*a* and 1112*a* and 11100*b* and 1112*b* of the respective monoblocks 1101 and 1103.

Further, and although not shown or described herein in any detail, it is understood that the end steps 1136*a* and 1136*b* could also be defined by an outwardly extending end section or region of the respective monoblocks 1101 and 1103 having a height or thickness greater than the height or thickness of the remainder of the respective monoblocks 1101 and 1103.

The monoblocks 1101 and 1103 additionally each comprise an electrical RF signal input/output electrode which, in the embodiment shown, is in the form of respective cylindrically shaped through-holes 1146*a* and 1146*b* (FIGS. 2 and 3) which extend through the body of the respective monoblocks 1101 and 1103 and, more specifically, extend through the respective steps 1136*a* and 1136*b* thereof and, still more specifically, through the body of the respective end resonators 1114 and 1122 defined in the respective monoblocks 1101 and 1103 between, and in relationship generally normal to, the respective surfaces 1140*a* and 1140*b* of the respective steps 1136*a* and 1136*b* and the respective surfaces 1104*a* and 1102*b* of the respective monoblocks 1101 and 1103.

Still more specifically, the respective input/output through-holes 1146*a* and 1146*b* are spaced from and generally parallel to the respective transverse side end surfaces 1112*a* and 1112*b* of the respective monoblocks 1101 and 1103 and define respective generally circular openings 1147*a* and 1147*b* located and terminating in the respective step surfaces 1140*a* and 1140*b* and respective opposed openings 1148*a* and 1148*b* terminating in the respective block surfaces 1104*a* and 1102*b* (FIG. 3).

The respective RF signal input/output through-holes 1146*a* and 1146*b* are also located and positioned in and extend through the interior of the respective monoblocks 1101 and 1103 in a relationship generally spaced from and parallel to the respective step wall or surfaces 1142*a* and 1142*b* and in a relationship and direction generally normal or transverse to the longitudinal axis of the respective monoblocks 1101 and 1103.

All of the external surfaces 1102*a*, 1104*a*, 1106*a*, 1108*a*, 1108*a*, 10*a*, and 1112*a* of the monoblock 1101, the external surfaces of the monoblock 1101 defining the slits 1124*a*, and the interior cylindrical surface of the monoblock 1101 defining the RF signal input/output through-hole 1146*a* are covered with a suitable conductive material, such as for example silver, with the exception of the regions described in more detail below including a ring shaped region 1170*a* (FIGS. 2 and 3) on the surface 1140*a* and surrounding the opening 1147*a* defined in the surface 1140*a* by the through-hole 1146*a*.

Similarly, all of the exterior surfaces 1102*b*, 1104*b*, 1106*b*, 1110*b*, and 1112*b* of the monoblock 1103, the external surfaces of the monoblock 1103 defining the slits 1124*b*, and the interior cylindrical surface of the monoblock 1103 defining the RF signal input/output through-hole 1146*b* are covered with a suitable conductive material, such as for example silver, with the exception of the regions described in more detail below including a ring shaped region 1170*b* (FIGS. 1, 2, and 3) on the surface 1140*b* and surrounding the opening 1147*b* defined in the surface 1140*b* by the through-hole 1146*b*.

The monoblocks 1101 and 1103 still further comprise respective RF signal input/output connectors 1400 protruding outwardly from the respective openings 1147*a* and 1147*b* defined in the respective surfaces 1140*a* and 1140*b* by the respective through-holes 1146*a* and 1146*b*.

As shown in FIGS. 1 and 2, the separate monoblocks 1101 and 1103 are coupled to and stacked on each other in an overlying and abutting and stacked relationship to define and form the waveguide filter 1100 in a manner in which the separate monoblocks 1101 and 1103, and more specifically the respective resonators thereof, are arranged in an overlying, abutting, and stacked relationship against each other as described in more detail below.

Specifically, the monoblocks 1101 and 1103 are coupled to each other in a relationship wherein, as shown in FIGS. 1, 2, and 3, the longitudinal horizontal exterior surface 1102*b* of the top monoblock 1103 is seated on and abutted against the longitudinal horizontal exterior surface 1104*a* of the bottom monoblock 1101.

Still more specifically, the monoblocks 1101 and 1103 are stacked against each other in a relationship wherein the horizontal surface 1104*a* of the monoblock 1101 is abutted against the horizontal surface 1102*b* of the monoblock 1103; a central interior layer 1150 of conductive material (FIGS. 1 and 2) which extends the length and width of the interior of the waveguide filter 1100 is sandwiched between the surface 1104*a* of the monoblock 1101 and the surface 1102*b* of the monoblock 1103, and is defined by the layer of conductive material covering the length and width of the external surfaces 1104*a* and 1102*b* of the respective monoblocks 1101 and 1103; the longitudinal side vertical exterior surface 1106*a* of the monoblock 1101 is co-planarly aligned with the longitudinal side vertical exterior surface 1106*b* of the monoblock 1103; the slots 1124*a* on the monoblock 1101 are co-linearly aligned with the slots 1124*b* on the monoblock 1103; the opposed longitudinal side vertical exterior surface 1108*a* of the monoblock 1101 is co-planarly aligned with the longitudinal side vertical exterior surface 1108*b* of the monoblock 1103; the transverse end side vertical exterior surface 1110*a* of the monoblock 1101 is co-planarly aligned with the transverse side vertical exterior surface 1110*b* of the monoblock 1103; and the opposed transverse end side vertical exterior surface 1112*a* of the monoblock 1101 is co-planarly aligned with the opposed transverse end side vertical exterior surface 1112*b* of the monoblock 1103.

Thus, in the relationship as shown in FIGS. 1 and 2, the respective end steps 1136*a* and 1136*b* on the respective monoblocks 1101 and 1103 are disposed in an opposed, abutting, and stacked relationship; the respective resonators 1114 and 1122 on the respective monoblocks 1101 and 1103 are disposed in an opposed, abutting, and stacked relationship; the respective resonators 1116 and 1121 on the respective monoblocks 1101 and 1103 are disposed in an opposed, abutting, and stacked relationship; and the respective resonators 1118 and 1120 on the respective monoblocks 1101 and 1103 are disposed in an opposed, abutting, and stacked relationship.

Thus, and as shown in FIG. 2, the waveguide filter 1100 is a generally parallelepiped-shaped block of dielectric material defining a longitudinal axis L3 and includes opposed, spaced-apart, and parallel bottom and top longitudinal horizontal exterior surfaces 1102 and 1104 that correspond to the respective exterior surfaces 1102*a* and 1102*b* of the respective monoblocks 1101 and 1103 and extend in the same direction as, and below and above and generally parallel to, the longitudinal axis L3; a central interior layer 1150 of conductive material that corresponds to the layer of conductive material on each of the surfaces 1104*a* and 1102*b* of the respective monoblocks 1101 and 1103 and extends through the full length and width of the interior of the waveguide filter 1100 in a generally horizontal co-planar relationship with the longitudinal axis L3 and further in a relationship spaced from and generally parallel to, the bottom and top horizontal longitudinal exterior surfaces 1102 and 1104; opposed, spaced-apart and parallel side vertical exterior surfaces 1106 and 1108 that correspond to the vertically co-planarly aligned surfaces 1106*a* and 1106*b* and 1108*a* and 1108*b* respectively of the respective monoblocks 1101 and 1103 and extending in the same direction as, and on opposite sides of and generally parallel to, the longitudinal axis L3; opposed, spaced-apart and parallel end side vertical exterior surfaces 1110 and 1112 corresponding to the vertically co-planarly aligned surfaces 1110*a* and 1110*b* and 1112*a* and 1112*b* of the respective monoblocks 1101 and 1103 and extend in a direction transverse or normal to, and intersecting, the longitudinal axis L3; a pair of spaced-apart and parallel slits or slots 1124 in the waveguide filter 1100 corresponding to the vertically co-linearly aligned slits or slots 1124*a* and 1124*b* in the respective monoblocks 1101 and 1103 and extending into the waveguide filter 1100 from the exterior vertical longitudinal surface 1106 and into the body of the waveguide filter 1100 in a relationship and direction transverse or normal to the longitudinal axis L3 and terminating in respective apertures or cut-outs in the bottom and top longitudinal horizontal surfaces 1102 and 1104; and an end section or region 1136 that is unitary with the resonators 1114 and 1122 and, in the embodiment shown, has a thickness or height less than the thickness or height of the remainder of the waveguide filter 1100.

In the embodiment shown, the end section or region 1136 defines a first generally L-shaped step or shoulder 1136*a* corresponding to the step 1136*a* defined in the monoblock 1101, which is located below and spaced from the longitudinal axis L3, and includes an exterior surface 1140*a* extending inwardly and spaced from and parallel to the bottom exterior surface 1102 of the waveguide filter 1100; and a diametrically opposed second generally L-shaped step or shoulder 1136*b* corresponding to the step 1136*b* in the monoblock 1103, which is located above and spaced from the longitudinal axis L3 and including an exterior surface 1140*b* extending inwardly and spaced from and parallel to the top exterior surface 1104 of the waveguide filter 1100.

A generally cylindrically shaped through-hole 1146*a* corresponding to the through-hole 1146*a* defined in the monoblock 1101 extends through the end section 1136, in a relationship and direction transverse and normal to and below the longitudinal axis L3, between a generally cylindrically shaped opening 1147*a* defined in the step surface 1140*a* and the central layer 1150 of conductive material.

A generally cylindrically shaped through-hole 1146*b* corresponding to the through-hole 1146*b* in the monoblock 1103 extends through the end section 1136, in a relationship co-linear with and diametrically opposed to the through-hole 1146*b* and in a relationship and direction transverse and normal to and above the longitudinal axis L3, between a generally cylindrically shaped opening 1147*b* defined in the step surface 1140*b* and the central layer 1150 of conductive material.

Thus, in the embodiment shown, the through-holes 1146*a* and 1146*b* are located in a diametrically opposed and co-linear relationship on opposite sides of, and in a relationship generally normal to, the central layer 1150 of conductive material and the longitudinal axis L3 of the waveguide filter 1100.ip Thus, in the embodiment of FIG. 2, each of the exterior surfaces 1102, 1104, 1106, 1108, 1110, 1112 of the waveguide filter 1100, the interior surface of the waveguide filter 1100 defining the respective slits/slots 1124, and the interior surface of the waveguide filter 1100 defining the respective through-holes 1146*a* and 1146*b* are covered or coated with a layer of conductive material with the exception of respective circular or ring shaped regions 1170*a* and 1170*b* 1151 surrounding the respective openings 1147*a* and 1147*b* defined by the respective through-holes 1146*a* and 1146*b* in the respective step surfaces 1140*a* and 1140*b* of the end section 1136.

The waveguide filter 1100 further comprises a first interior or internal RF signal transmission window or means or coupling 1622 (FIGS. 2 and 3), which in the embodiment shown is in the shape of a rectangle extending in a direction transverse to and intersecting the longitudinal axis L3, that provides for a direct inductive path or window or coupling for the transmission of the RF signal between the respective resonators 1118 and 1120 of the waveguide filter 1100 and, more specifically, between the resonators 1118 and 1120 of the respective monoblocks 1101 and 1103 coupled together to define the waveguide filter 1100.

In the embodiment shown, the window 1622 comprises a generally rectangularly shaped aperture or void or opening or window that is defined in the central layer 1150 of conductive material and is formed in the region of the central layer 1150 located between the resonators 1118 and 1120. More specifically, the window 1622 is defined by respective generally rectangularly shaped apertures or voids or openings or windows 1622*a* and 1622*b* that are formed in the layer of conductive material that covers the respective exterior surfaces 1104*a* and 1102*b* of the respective monoblocks 1101 and 1103 and located thereon in the region of the respective resonators 1118 and 1120. The windows 1622*a* and 1622*b* are aligned with each other when the monoblocks 1101 and 1103 are coupled together to define the central layer 1150 of conductive material and the window 1622 therein.

Stated another way, the window 1622 is defined by respective generally rectangularly shaped regions 1622*a* and 1622*b* of dielectric material on the respective exterior surfaces 1104*a* and 1102*b* of the respective monoblocks 1101 and 1103 which upon alignment with each other when the monoblocks 1101 and 1103 are coupled together defines the interior RF signal transmission window 1622.

In accordance with this embodiment, the window 1622 located in the interior of the waveguide filter 1100 between the resonators 1118 and 1120 allows for the internal or interior direct inductive passage or transmission of an RF signal from the resonator 1118 into the resonator 1120 of the waveguide filter 1100.

The waveguide filter 1100 additionally comprises a first indirect or cross-coupling interior or internal capacitive RF signal transmission window or means or coupling 1722 located in the interior of the waveguide filter 1100 between the resonators 1116 and 1121, which in the embodiment shown is in the shape of a rectangle extending in the same direction as and co-linear with the longitudinal axis L3 and the window 1622, for transmitting an RF transmission signal between the respective resonators 1116 and 1121 of the waveguide filter 1100 and, more specifically, between the resonators 1116 and 1121 of the respective monoblocks 1101 and 1103 coupled together to define the waveguide filter 1100.

In the embodiment shown, the window 1722 comprises a generally rectangularly shaped aperture or void or opening or window that is defined in the central layer 1150 of conductive material and is formed in the region of the central layer 1150 located between the resonators 1116 and 1121. Thus, the window 1722 is defined by respective generally rectangularly shaped apertures or voids or openings or windows 1722*a* and 1722*b* that are formed in the layer of conductive material that covers the respective exterior surfaces 1104*a* and 1102*b* of the respective monoblocks 1101 and 1103 and are located in the region of the respective resonators 1116 and 1121. The windows 1722*a* and 1722*b* are aligned with each other when the monoblocks 1101 and

1103 are coupled together to define the central layer 1150 of conductive material and the window 1722 therein.

Stated another way, the window 1722 is defined by respective generally rectangularly shaped regions 1722*a* and 1722*b* of dielectric material on the respective exterior surfaces 1104*a* and 1102*b* of the respective monoblocks 1101 and 1103 which upon alignment with each other when the monoblocks 1101 and 1103 are coupled together defines the interior RF signal transmission window 1722.

In accordance with the invention, the waveguide filter 1100 defines a first magnetic or inductive generally oval-shaped direct coupling RF signal transmission path for RF signals, generally designated by the arrows d in FIG. 2, as described below.

Initially, the RF signal is transmitted into the connector 1400 and the through-hole 1146*a* in the embodiment where the through-hole 1146*a* in the monoblock 1101 defines the RF signal input through-hole. Thereafter, the RF signal is transmitted into the end section 1136 and, more specifically, the end step 1136*a* on the monoblock 1101; then into the resonator 1114 in monoblock 1101; then into the resonator 1116 in monoblock 1101 via the RF signal transmission bridge or pass 1128; and then into the resonator 1118 in monoblock 1101 via the RF signal transmission bridge or pass 1130.

Thereafter, the RF signal is transmitted from the monoblock 1101 into the monoblock 1103 and, more specifically, from the resonator 1118 in the monoblock 1101 into the resonator 1120 in the monoblock 1103 via the interior inductive RF signal transmission window 1622 located in the interior of the waveguide filter 1100 between the resonators 1118 and 1120.

Thereafter, the RF signal is transmitted into the resonator 1121 in the monoblock 1103 via the RF signal transmission bridge or pass 1132; then into the resonator 1122 in monoblock 1103 via the RF signal transmission bridge or pass 1134; then into the end section 1136 of monoblock 1103 and, more specifically, into the step 1136*b* of monoblock 1103; and then out through the through-hole 1146*b* and the connector 1400 in the end section 1136 of monoblock 1103 in the embodiment where the through-hole 1146*b* in the monoblock 1103 defines the RF signal output through-hole.

In accordance with this embodiment of the present invention, the waveguide filter 1100 also defines and provides an alternate or indirect- or cross-coupling RF signal transmission path for RF signals generally designated by the arrow c in FIG. 2.

Specifically, the cross-coupling or indirect capacitive RF signal transmission path c is defined and created by the interior RF signal transmission means or window 1722 located between the resonators 1116 and 1121 which allows for the transmission of a small portion of the direct RF signal being transmitted through the resonator 1116 of the monoblock 1101 directly into the resonator 1121 of the monoblock 1103.

In accordance with the present invention and as shown in FIG. 3 wherein the area or size of the RF signal transmission window 1622 is larger than the area or size of the RF signal transmission window 1722, the internal RF signal transmission window 1622 between and interconnecting the respective resonators 1118 and 1120 of the respective monoblocks 1101 and 1103 of waveguide filter 1100 is designed/sized to create an inductive direct RF signal coupling stronger than the indirect, capacitive cross-coupling created and defined by the internal RF transmission window 1722 between and interconnecting the respective resonators 1116 and 1121 of the respective monoblocks 1101 and 1103 of waveguide filter 1100.

Figure 4:
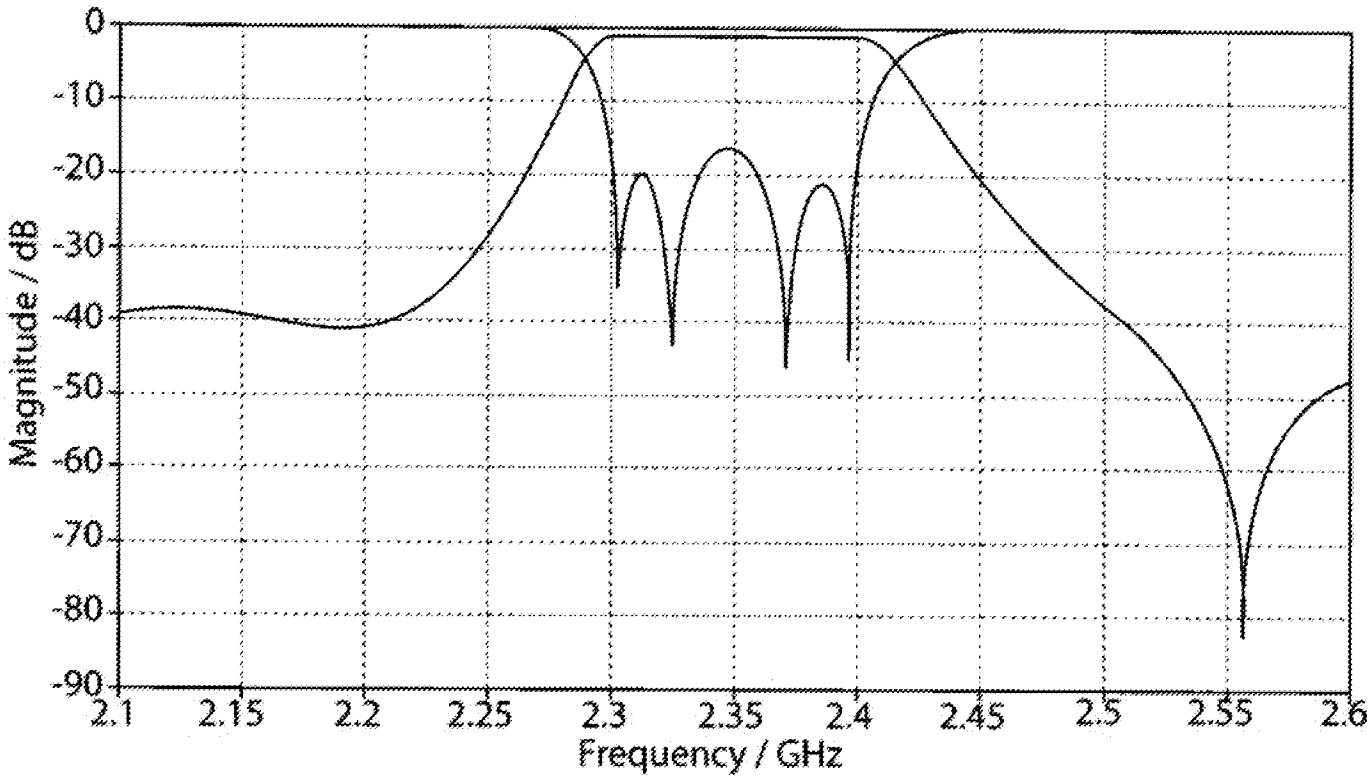
FIG. 4 is a graph depicting the performance of the dielectric waveguide filter shown in FIG. 1.

FIG. 4 is a graph which shows the calculated frequency response of the high performance dielectric waveguide filter 1100 which, in the embodiment shown, is comprised of and includes the following performance characteristics: monoblocks 1103 and 1103 each comprised of a high quality C14 ceramic material with a dielectric constant of about 37 or above; monoblocks 1101 and 1103 each being approximately 2 inches in length, 0.5 inches in width, and 1.1 inches in height; a bandwidth up to five percent (5%) of the center frequency; power handling up to two hundred watts (200 W); resonators having a Q in the range between about one thousand to two thousand (1000-2000); insertion loss of about minus two dB (−2 dB); out of band rejection of about minus seventy dB (−70 dB); bandwidth in the range of between about forty to one hundred Megahertz (40-100 MHz); and a center frequency of about two Gigahertz (2 GHz).

Figure 5:
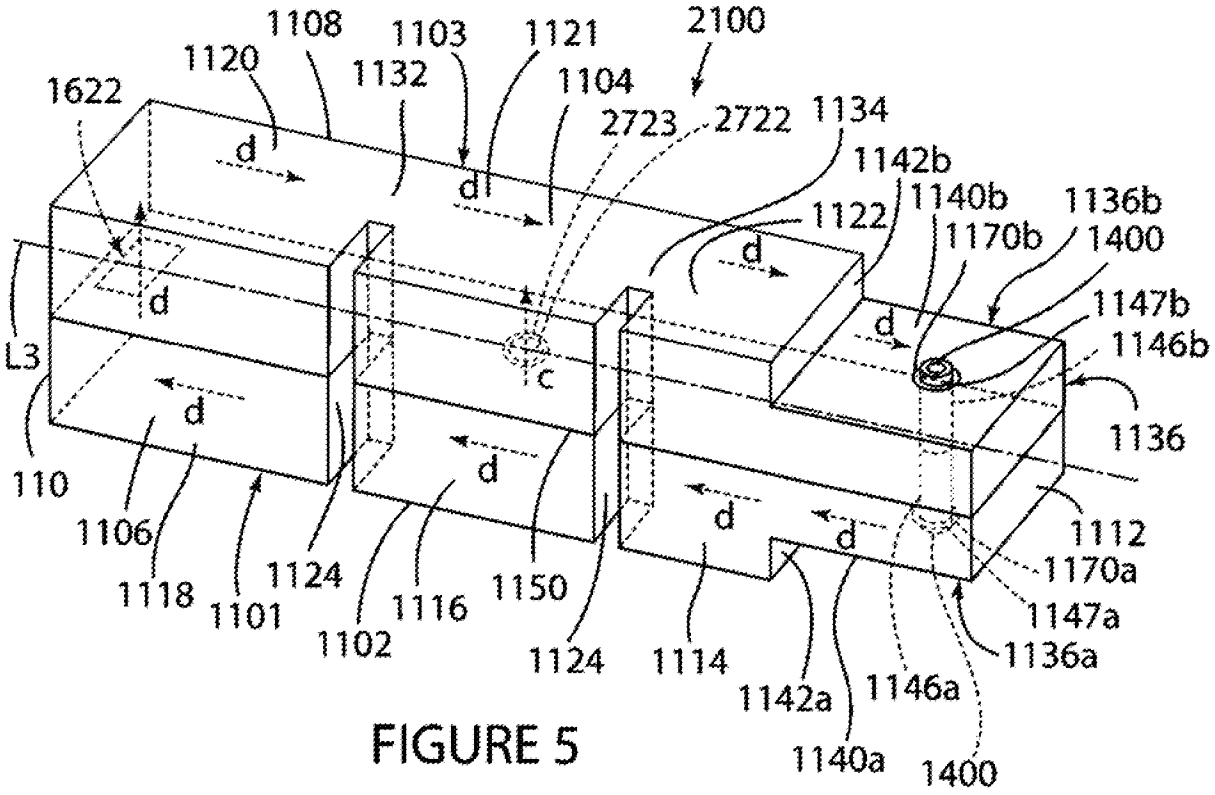
FIG. 5 is an enlarged, part phantom, perspective view of another embodiment of a dielectric waveguide filter according to the present invention.

FIG. 5 is another embodiment of a dielectric waveguide filter 2100 in accordance with the present invention which is identical, in all but one respect as discussed below, to the structure, elements, and function of the dielectric waveguide filter 1100, and thus the numerals used to designate the various elements of the waveguide filter 1100 in FIGS. 1-3 have been used to identify and designate the same elements in the waveguide filter 2100 shown in FIG. 5 and thus the earlier description of the structure and function of each of the elements of the waveguide filter 1100 is incorporated herein by reference and applies to and is repeated herein with respect to each of the elements identified in FIG. 5 with respect to the waveguide filter 2100 as though such description was fully set forth herein.

The waveguide filter 2100 shown in FIG. 5 differs from the waveguide filter 1100 shown in FIGS. 1-3 in that the rectangularly shaped indirect or cross-coupling interior or internal capacitive RF signal transmission window or means or coupling 1722 located in the interior of the waveguide filter 1100 between the resonators 1116 and 1121 has been substituted in the waveguide filter 2100 shown in FIG. 5 with a round or circular shaped indirect or cross-coupling interior or internal capacitive RF signal transmission window or means or coupling 2722 located in the interior of the waveguide filter 2100 between the resonators 1116 and 1121.

In the embodiment shown, the window 2722 comprises a generally round or circular shaped region or portion or patch or pad of the conductive or metal material defining the central interior layer 1150 of conductive material that is surrounded by a generally ring shaped region 2723 which is devoid of conductive material (i.e., a region of dielectric material) that isolates the window or patch of conductive material 2722 from the remainder of the conductive material of the central interior layer 1150 of conductive material and is formed in the region of the central layer 1150 located between the resonators 1116 and 1121.

Figure 6:
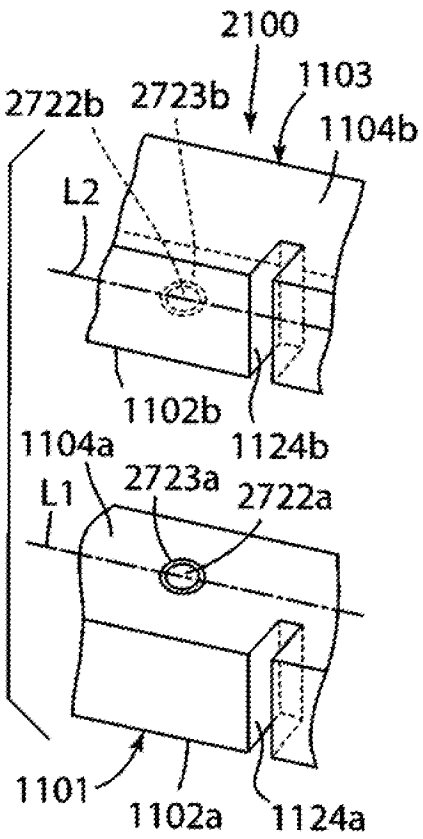
FIG. 6 is an enlarged, exploded, broken, part phantom, perspective view of the two blocks of the dielectric waveguide filter shown in FIG. 5.

Thus, and as shown in FIG. 6, the window 2722 is defined by respective generally circular shaped regions or portions or patches or pads 2722*a* and 2722*b* of the conductive material on the respective exterior surfaces 1104*a* and 1102*b* of the respective monoblocks 1101 and 1103 that are surrounded by respective ring shaped regions 2723*a* and 2723*b* of the respective exterior surfaces 1104*a* and 1102*b* which are devoid of conductive material (i.e., respective regions of dielectric material) that isolate the respective windows or patches of conductive material 2722*a* and 2722*b* from the remainder of the layer of conductive material covering the respective exterior surfaces 1104*a* and 1102*b*. The respective windows 2722*a* and 2722*b* are located on the respective exterior surfaces 1104*a* and 1102*b* of the respective monoblocks 1101 and 1103 in the region of the respective resonators 1116 and 1121.

The windows 2722*a* and 2722*b* are aligned with and connected to each other when the monoblocks 1101 and 1103 are coupled together to define the central layer 1150 of conductive material and the window 2722 therein.

In this embodiment, a cross-coupling or indirect capacitive RF signal transmission path c is defined and created by the interior RF signal transmission means or window 2722 located between the resonators 1116 and 1121 which allows for the transmission of a small portion of the direct RF signal being transmitted through the resonator 1116 of the monoblock 1101 directly into the resonator 1121 of the monoblock 1103.

While the invention has been taught with specific reference to the embodiments shown, it is understood that a person of ordinary skill in the art will recognize that changes can be made in form and detail without departing from the spirit and the scope of the invention. The described embodiments are to be considered in all respects only as illustrative and not restrictive.

For example, it is understood that the configuration, size, shape, and location of several of the elements of the waveguide filter including, but not limited to, the windows, steps, through-holes, and slits/slots of the waveguide filter may be adjusted depending upon the particular application or desired performance characteristics of the waveguide filter.

We claim:

1. A dielectric waveguide filter for a transmission of an RF signal comprising:

a first solid and separate block of dielectric material defining a first longitudinal axis and including a plurality of exterior surfaces covered with a layer of conductive material;

one or more first open slots extending into one or more of the plurality of exterior surfaces and the dielectric material and separating the first solid and separate block of the dielectric material into a plurality of first resonators;

one or more first RF signal transmission bridges of the dielectric material on the first solid and separate block of dielectric material being co-linear with the one or more first open slots respectively and defining a first path for the transmission of the RF signal between each of the plurality of first resonators in a direction along the first longitudinal axis;

a first RF signal transmission window defined in the layer of conductive material in a region of one of the plurality of first resonators;

a second solid and separate block of dielectric material defining a second longitudinal axis and including a plurality of exterior surfaces covered with a layer of conductive material;

one or more second open slots extending into one or more of the plurality of exterior surfaces and the dielectric material of the second solid and separate block and separating the second solid and separate block of dielectric material into a plurality of second resonators;

one or more second RF signal transmission bridges of the dielectric material on the second solid and separate block of dielectric material co-linear with the one or more second open slots and defining a second path for the transmission of the RF signal between each of the plurality of second resonators in a direction along the second longitudinal axis;

a second RF signal transmission window defined in the layer of conductive material of the second solid and separate block in a region of one of the plurality of second resonators; and the first and second solid and separate blocks of dielectric material being coupled to each other in a relationship wherein one of the plurality of exterior surfaces of the second solid and separate block of dielectric material is abutted against one of the plurality of exterior surfaces of the first block of dielectric material and the first and second RF signal transmission windows are aligned with each other and define a third path for the transmission of the RF signal between the first and second solid and separate blocks of dielectric material in a direction normal to the first and second longitudinal axis.

2. The dielectric waveguide filter of claim 1 further comprising:

a third RF signal transmission window defined in the layer of conductive material in the region of the plurality of first resonators; and a fourth RF signal transmission window defined in the layer of conductive material covering the exterior surface of the second solid and separate block of dielectric material in the region of the plurality of second resonators; and the third and fourth RF signal transmission windows being aligned with each other and defining a fourth path for the transmission of the RF signal between the first and second solid and separate blocks of dielectric material in the direction normal to the first and second longitudinal axis.

3. The dielectric waveguide filter of claim 2 further comprising first and second RF signal input/output electrodes defined on the first and second solid and separate blocks of dielectric material.

4. The dielectric waveguide filter of claim 3 further comprising one or more steps defined in the first and/or second solid and separate blocks of dielectric material.

5. A dielectric waveguide filter for the transmission of an RF signal comprising:

a first solid and separate block of dielectric material defining a first longitudinal axis and including a plurality of exterior surfaces covered with a layer of conductive material, a first plurality of open slots defined in the dielectric material and extending in a direction perpendicular to a direction of the first longitudinal axis and separating the first solid and separate block of dielectric material into a first plurality of resonators extending along the first longitudinal axis, and a first step defined in the first solid and separate block of dielectric material;

a first plurality of RF signal transmission bridges of the dielectric material on the first solid and separate block of dielectric material co-linear with the first plurality of open slots respectively and defining a first path for the transmission of the RF signal through the first plurality of resonators in the direction of the first longitudinal axis;

a first RF signal transmission window defined in the layer of conductive material;

a first RF signal input/output through-hole defined in the first solid and separate block of dielectric material;

a second solid and separate block of dielectric material defining a second longitudinal axis and including a plurality of exterior surfaces covered with a layer of conductive material, a second plurality of open slots defined in the dielectric material of the second solid and separate block and extending in a direction perpendicular to a direction of the second longitudinal axis and separating the second solid and separate block of dielectric material into a second plurality of resonators extending along the second longitudinal axis;

a second plurality of RF signal transmission bridges of dielectric material on the second solid and separate block of dielectric material co-linear with the second plurality of open slots respectively and defining a second path for the transmission of the RF signal through the second plurality of resonators in the direction of the second longitudinal axis;

a second RF signal transmission window defined in the layer of conductive material of the second solid and separate block;

a first direct RF signal transmission path defined through the first and second solid and separate blocks of dielectric material respectively; and the first and second solid and separate blocks of dielectric material being coupled to each other with one of the plurality of exterior surfaces of the second solid and separate block of dielectric material abutted against one of the plurality of exterior surfaces of the first solid and separate block of dielectric material and the first and second RF signal transmission windows aligned with each other and defining a third path for the transmission of the RF signal between a first one of the first plurality of resonators in the first solid and separate block of dielectric material and a first one of the second plurality of resonators in the second solid and separate block of dielectric material in a direction normal to the first and second longitudinal axis.

6. The dielectric waveguide filter of claim 5 further comprising a fourth path for the transmission of the RF signal between the first and second solid and separate blocks of dielectric material.

7. The dielectric waveguide filter of claim further comprising:

a third RE signal transmission window defined in the layer of conductive Material in a region of one of the first plurality of resonators; and a fourth RF signal transmission window defined in the layer of conductive material in a region of one of the second plurality of resonators;

the third and fourth RF signal transmission windows being aligned with each other when the first and second solid and separate blocks of dielectric material are coupled to each other and define the fourth path for the transmission of the RF signal between the first and second solid and separate blocks of dielectric material in the direction normal to the first and second longitudinal axis.

8. The dielectric wave guide filter of claim 7 wherein the first direct RF signal transmission path is generally oval in shape.

* * * * *